US005339977A

United States Patent [19]

Schormair et al.

[11] Patent Number: 5,339,977

[45] Date of Patent: Aug. 23, 1994

[54] PRESSURE LID CAN

[75] Inventors: Eckhart Schormair, Otersen; Jurgen Ponisch, Bruhl; Rainer Laaf, Hellenthal, all of Fed. Rep. of Germany

[73] Assignee: EFFEM GmbH, Verden/Aller, Fed. Rep. of Germany

[21] Appl. No.: 856,057

[22] PCT Filed: Sep. 3, 1991

[86] PCT No.: PCT/DE91/00699

§ 371 Date: Jun. 8, 1992

§ 102(e) Date: Jun. 8, 1992

[87] PCT Pub. No.: WO92/04247

PCT Pub. Date: Mar. 19, 1992

[30] Foreign Application Priority Data

Sep. 11, 1990 [DE] Fed. Rep. of Germany ..... 4029146

[51] Int. Cl.[5] ..... B65D 43/04

[52] U.S. Cl. ..... 220/307; 220/308; 220/284; 220/672

[58] Field of Search ..... 220/307, 308, 284, 285, 220/614, 618, 669, 672

[56] References Cited

U.S. PATENT DOCUMENTS

| | | | |
|---|---|---|---|
| 1,643,252 | 9/1927 | McCrery | 220/614 X |
| 2,344,894 | 3/1944 | Ottesen | 220/284 |
| 2,416,693 | 3/1947 | Hills | 220/284 X |
| 2,467,392 | 4/1949 | Kinberg | 220/284 |
| 3,329,302 | 7/1967 | Kitchen | 220/284 |
| 3,456,837 | 7/1969 | Medley | 220/284 |
| 3,514,011 | 5/1970 | Madeira et al. | 220/284 |
| 3,616,962 | 11/1971 | Phipps | 220/308 |
| 3,791,551 | 2/1974 | Madeira | 220/307 |
| 4,171,063 | 10/1979 | Cloutier | 220/307 |
| 4,676,392 | 6/1987 | Giggard et al. | 220/284 |

FOREIGN PATENT DOCUMENTS

| | | | |
|---|---|---|---|
| 45450 | 9/1935 | France | 220/307 |
| 128197 | 4/1927 | Switzerland | 220/307 |
| 607701 | 10/1978 | Switzerland . | |
| 742814 | of 1956 | United Kingdom . | |
| 2033880 | of 1979 | United Kingdom . | |

*Primary Examiner*—Allan N. Shoap
*Assistant Examiner*—Vanessa Caretto
*Attorney, Agent, or Firm*—Curtis, Morris & Safford

[57] ABSTRACT

In a pressure lid can (1) with an at least one-piece body member (2) and a lid member (4), which together with a body element (6) located at the closure-side end of the body member (2) forms a tight closure, in which a lever gap (26) between the body member (2) and the lid member (4) is left free for the application of a lever by means of which the lid member (4) can be levered up, the lid member (4) has an all-round, resilient engagement lip (8), which engages from the inside under pretension in a closure corrugation (10) of the body element (6) adapted to the engagement lip shape.

6 Claims, 3 Drawing Sheets

PRESSURE LID CAN

FIELD OF THE INVENTION

The invention relates to a pressure lid can with an at least one-piece body member and a lid member which, together with a body element located on the closure-side end of the body member forms a tight closure, in which a lever gap is left between the body member and the lid member for the application of a lever by means of which the lid member can be levered up, as well as to a method for the manufacture of a hermetically sealed lid closure for a pressure lid can.

Such a pressure lid can is e.g. used as a paint can, whereof the press-in lid has a radially projecting rim, beneath which can be applied a lever, e.g. a screwdriver and the latter opens the lid closure in conjunction with the upper edge of the body member.

Such a pressure lid can is not suitable for perishable foods, which have to be sterilized, because during sterilization a high internal pressure occurs, which cannot be withstood by the closure.

In addition, a sterilizable grooved lid can is known (EP-OS 0 377 788), whose lid is fixed by a double grooved closure to the body member. The lid is provided in its marginal area with a ring groove-like depression serving as a lever gap, so as to be able to apply a lever, e.g. a spoon and in this way lever up the lid. For this purpose the sheet metal thickness in the bottom of the ring groove-like depression is weakened in the manner of tear-open lids by a crevice, so that on applying the lever the lid opens in the manner of tear-open closures without it being necessary to fix a pulling tab to the lid. The disadvantage of this sterilizable grooved lid can is the injury risk constituted by the sharp edge of the closure left behind on the body member. In addition, the disadvantages known in connection with tear-open closures still exist with respect to the functional reliability, if the weakening of the lid thickness by means of the crevice is not carried out with extreme accuracy. In addition, the handling security is impaired in that even minor impacts on the lid, e.g. during the transportation of grooved lid cans, can result in a closure leak due to the breaking open of the crevice. An additional disadvantage is that the lid is destroyed on opening, so that the can cannot be resealed with the original lid. Due to the necessary manufacturing precision such a closure is also expensive.

SUMMARY AND OBJECTS OF THE INVENTION

The problem to which the invention is directed to is to create a pressure lid can with a leverable lid closure, which on the one hand has a high sealing action and on the other which is easy to open and whose closure can be manufactured more simply and less expensively.

According to the invention this problem is solved in that the lid body has an all-round, resilient engagement or application lip, which engages in a closure corrugation of the body element from the inside and is accompanied by pretension.

The invention advantageously makes it possible to resiliently secure the lid member in the closure corrugation of the body element, so that the closure is held in the closure corrugation plane under pretension, in that the engagement lip is pressed with elastic force into the closure corrugation. The application of the lever to the lever gap ensures that on the one hand the engagement lip is drawn radially inwards, whilst the body element is pressed outwards. Thus, in the vicinity of the lever the engagement lip is disengaged from the closure corrugation, so that during further pivoting of the lever the lid can be completely levered out. The cross-sectional form of the closure corrugation is adapted to the engagement lip form, which ensures a more reliable seating of the closure and a high sealing action.

On closing the pressure lid can the engagement lip is initially pressed back radially inwards by the deformation of the all-round, resilient leg of the upper part and subsequently is locked under pretension in the body corrugation. The resilient design of the engagement lip additionally assists the sealing action in the body corrugation. The main advantage of such a closure is that such a pressure lid can can be non-destructively, simply opened particularly with respect to the lid and without using a special tool. Due to the engagement with high spring tension of the closure, an extremely tight seal can be obtained. A further important advantage is the resealability of the pressure lid can, which allows multiple use. It is also possible to use the pressure lid can more than once.

The engagement lip is preferably connected to a, considered cross-sectionally, resilient leg of the lid top part, so that on applying the lever to the resilient leg an easy pressing back of the engagement lip in the radial inwards direction is possible.

In a preferred embodiment the engagement lip is located at the outer end of a substantially horizontal ring flange of the lid body. The substantially horizontal ring flange with engagement lip permits a high sealing force due to the elastic force acting radially outwards against the closure corrugation.

The ring flange can project from the resilient leg of the lid top part and consequently transfer the tension of the resilient leg to the engagement lip and simultaneously determine the direction of the spring tension on the closure corrugation, as a function of its inclination relative to the body member.

Preferably the closure corrugation is stamped outwards. Following radial contraction on pressing on the lid body, the engagement lip can elastically snap into such a closure corrugation.

Below the closure corrugation can be located at inwardly stamped, lower body corrugation. The lower, inwardly stamped body corrugation makes it possible to support the lid body on the side opposite to the lever application point on opening the lid.

It is also possible to arrange above the closure corrugation a second, inwardly stamped, upper body corrugation which increases the sealing action of the closure.

In a preferred embodiment a sealant is provided between the body corrugation and the engagement lip. The sealant makes it possible to hermetically seal the pressure lid can, the can content being sterilizable with the pressure lid can closed. During sterilization the inventive lid closure is of particular advantage, because the internal pressure assists the sealing in that it acts on the resilient leg and consequently during the sterilization process increases the pressing force of the engagement lip against the closure corrugation. This improved lid closure sealing under internal pressure advantageously also permits sterilization without counterpressure. When the content is introduced hot on cooling a further advantage occurs due to the body contraction, in that the diameter reduction of the body improves sealing on cooling.

Preferably the body element is in one piece with the body member. This has the advantage that the body-side closure element can be inexpensively produced by corrugation production in the body member.

In another embodiment the body element is connected as a separate part to the closure-side end of the body member via a double grooved closure. Such a body element can be prefabricated together with the lid body and can then be connected by the filling plant in a conventional manner, namely by means of a double grooved closure, to the body member. This is particularly advantageous in the case of one-piece body members. In the case of a separate body element, it is also advantageous that the lower, inwardly stamped body corrugation can project further radially inwards, so that on opening the lid is better supported on the lower body corrugation.

The engagement lip is preferably formed by rolling on the lid body rim. In this way the engagement lip is manufactured in a simple manner, whilst ensuring an adequate rigidity of said lip. The rolled on portion can still be resilient and therefore contributes to the improved sealing in the body corrugation.

A force application corrugation in the lid member, which is lower than the upper edge of the body member, permits a clearly defined application of a lever at an optimum force application point of the resilient leg.

The force application corrugation of the lid member is preferably located above the engagement lip in the upper part of the lid member. On applying the lever in the force application corrugation the engagement lip is drawn radially inwards, which facilitates opening of the lid closure.

In another embodiment the gap width is reduced in at least part of the circumference and a lever engagement zone is provided opposite to the gap width-reduced area. The gap width reduction in at least part of the circumference permits during the opening of the lid member to support the same on the upper edge of the pressure lid can, so that the lid does not dip into the content.

Preferably the pivot axis for the engagement lip is in the periphery of the upper edge of the lid upper part immediately alongside the lever gap. Thus, even in the case of a limited lever movement the engagement lip is disengaged from the closure corrugation.

In a particularly preferred embodiment the body element is located in an inwardly necked, upper body portion. As a result of the diameter reduction in the upper area of the pressure lid can, advantageously a can stackability is obtained, without loading the lid member with the weight of the cans located above it. A further advantage is that the lid diameter is reduced, which leads to not inconsiderable material savings in the case of mass production.

BRIEF DESCRIPTION OF THE DRAWINGS

The invention is described in greater detail hereinafter relative to non-limitative embodiments and the attached drawings, wherein show.

DETAILED DESCRIPTION

Figure 1:
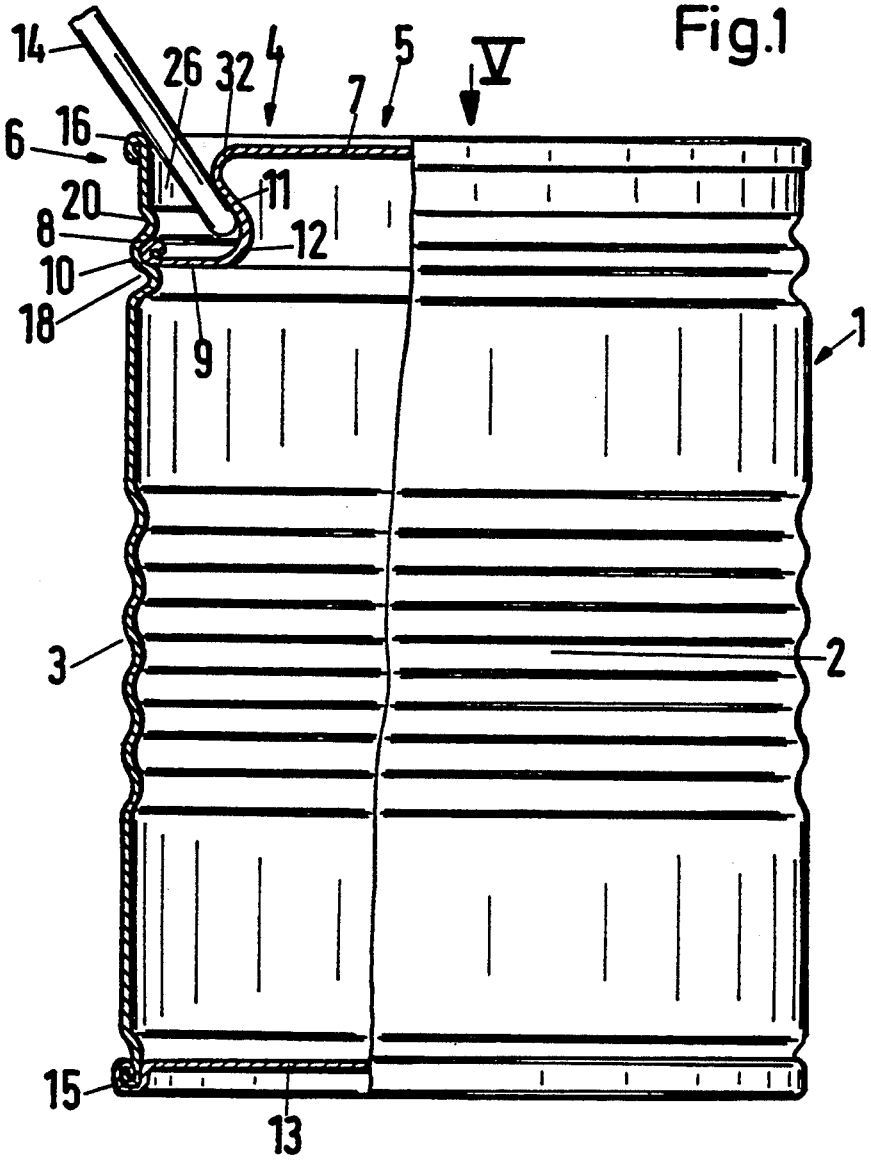
FIG. 1 is a side view, partly in section, depicting a can and lid constructed in accordance with a first embodiment of the invention, with a removal lever in position.

The pressure lid can 1 comprises a cylindrical body member 2, in whose central region are provided stability corrugations 3. The pressure lid can is downwardly provided over a double grooved closure 15 with a bottom 13, which can have expansion corrugations.

At the upper end of the body member 2 the pressure lid can is closed with a lid member 4 which, in the lid top 5 and considered cross-sectionally is provided with a resilient leg region 11, which passes into a substantially horizontal ring flange 9, on whose outer end is provided an application or engagement lip 8, which is preferably rolled on, the rolled-on end being directed outwards.

The engagement lip 8 engages in a closure corrugation 10 of the body member 2, which in the embodiment of FIG. 1 is stamped radially outwards and is more pronounced than the stability corrugations 3. Below the closure corrugation 10 can be provided a particularly pronounced lower body corrugation 18, which is stamped radially inwards and on which can be supported during pivoting the lid member 4.

Above the closure corrugation 10 can be provided an upper, radially inwardly stamped body corrugation 20, which also through subsequent pressing, i.e. after joining together the lid member 4 and the body member 2 and as a function of the necessary pressure resistance, can be additionally hollowed.

Figure 3:
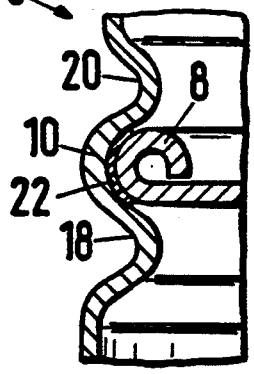
FIG. 3 is a larger scale sectional detail in the vicinity of the closure portion of the lid depicted in FIG. 1 or FIG. 2.

In the case of a hermetic seal of the lid closure, as shown in FIG. 3, a sealant 22 can be provided between the engagement lip 8 and the closure corrugation 10, the lid member 4 and body member 2 preferably being joined together with the sealant 22 still liquid. The increased pressure resistance attainable through subsequent hollowing of the body corrugation 20 interacts with the opening behaviour. It is possible to define different, subsequent hollowing effects of the body corrugation 20, individually for each filled product to be sterilized, so that for each can diameter, each sheet metal thickness and/or for each filled product an optimum between the pressure resistance and the opening behaviour is obtained.

To the lever gap 26 remaining between the body member 2 and the lid top 5 of the lid member 4 can be applied a lever 14, which is supported with its free end against the resilient leg 11 of the lid top and uses as a lever support the upper edge 16 of the body member 2. The lever 14 can press back radially inwards the resilient leg 11, whilst simultaneously the body member 2 is pressed slightly outwards. As a result of the springing back of the resilient leg 11 of the lid top, there is also a forcing back of the substantially horizontal ring flange with the engagement lip in the lever engagement or application area 30, so that the lid member 4 is initially disengaged from the closure corrugation 10 and then jumps completely out of the latter when lever movement is continued.

It is particularly advantageous with a hermetic lid closure with sealant 22, that the high internal pressure during sterilization assists the seal in that said internal pressure also presses radially outwards onto the resilient leg region 11 and consequently brings about reinforced pressing of the engagement lip 8.

Another advantage is that the body member 2 contracts on cooling, so that the diameter reduction also has a positive effect on the sealing action. No matter whether a sealant 22 is inserted or not, the lid member 4 of the pressure lid can 1 can be reused for resealing the latter.

Figure 2:
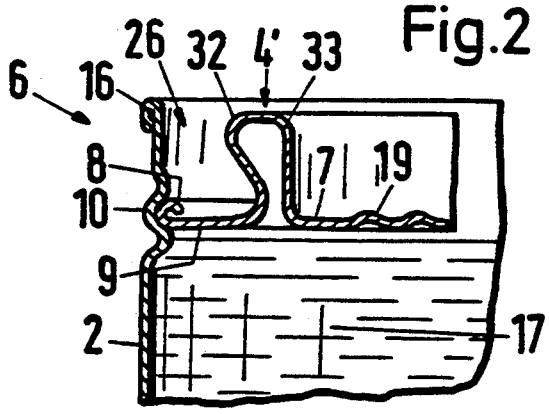
FIG. 2 is a sectional side view depicting an embodiment of a lid constructed in accordance with the invention having a deep-drawn surface.

FIG. 2 shows another embodiment of a lid with a lid member 4', whose inner region is deep drawn in such a way that in said region the lid surface 7 is in the plane of the ring flange 9. The lid member 4' can, as in the other embodiments of a lid member, be provided with lid corrugations 19 in the lid bottom 7.

In the embodiments of FIGS. 1, 2, 7 and 11, the upper edge 16 of the body member 2 can be rolled on outwards, the rolled on portion projecting over the body diameter or can radially inwardly be set back by necking in such a way that the upper edge 16 has the same or slightly smaller diameter than the body.

Figure 4:
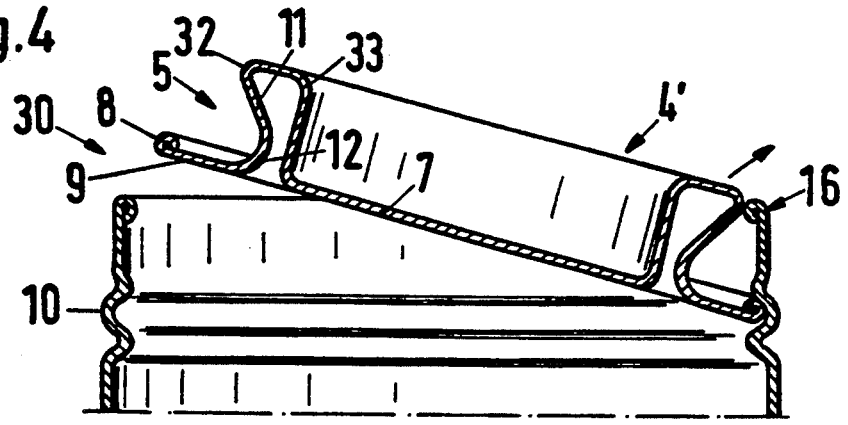
FIG. 4 is a sectional side view of a can and lid constructed in accordance with an embodiment of the invention and having a support on opening of the lid top, depicted during opening.

The embodiment of FIG. 4 shows a lid member 4', as in FIG. 2, without lid corrugations 19 in a partly pivoted state on opening the lid. The upper edge 16 of the body member 2 is rolled inwards, without colliding with the engagement lip 8 on opening. The lid member 4' is designed in such a way that the upper end of the resilient leg 11, on pivoting out the lid member 4' about the pivot axis of the latter located opposite the lever application region 30 in the vicinity of the closure corrugation 10, is supported on the inwardly rolled-on upper edge 16 and consequently prevents the lid member from dipping into the filled product 17.

The design of the lid according to the embodiments according to FIGS. 2 and 4 gives increased elasticity to the engagement lip 8, in that besides the pivot pin 32 in the peripheral region of the lid top 5, a further pivot pin 33 is formed at the beginning of the deep-drawn region by the deep drawing of the lid member 4'.

Figure 5:
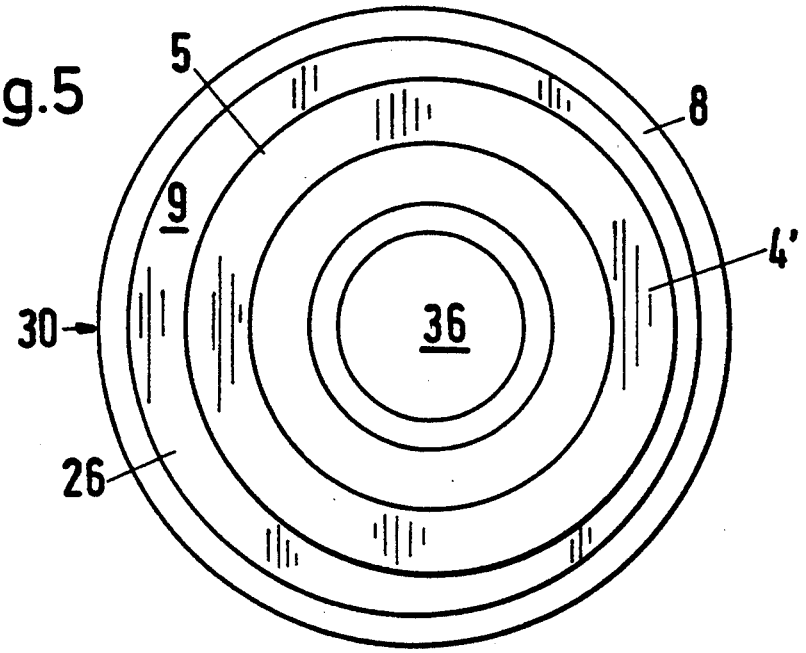
FIG. 5 is a plan view of a lid constructed in accordance with an another embodiment of the invention with eccentric stampings.

FIG. 5 is a plan view of a lid member with eccentric lid stamping, in which the lever gap 26 has in the circumferential direction of the pressure lid can a different gap width due to the eccentricity of the lid top 5 projecting from the ring flange 9. At the point of the minimum gap width, said reduced gap width permits a good supporting on the can upper edge 16, as shown in FIG. 4, when the lever 14 is applied to the point of maximum gap width. A vacuum tester 36 can also be stamped into the lid surface and, as shown in FIG. 4, the lid bottom 7 can be deep drawn.

Figure 6:
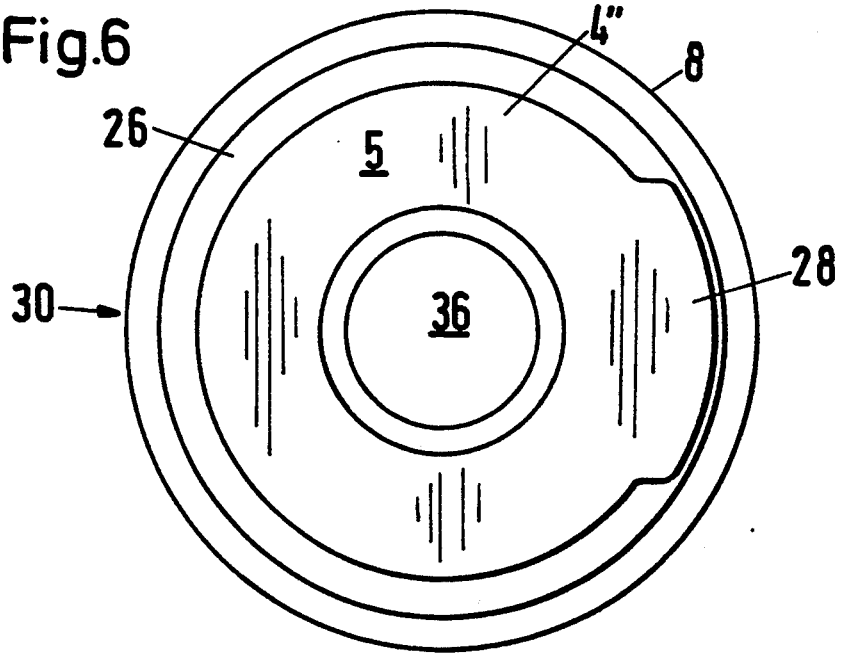
FIG. 6 is a plan view of a lid constructed in accordance with another embodiment of the invention with a partly size-reduced ring clearance between the lid member and the body member.

FIG. 6 shows a further embodiment of the lid with a lid member 4'' with a lid top 5 concentric to the engagement lid 8. The lid top 5 is provided at one point with a stamped portion 28, which reduces the gap width of the lever gap 26 in part of the circumference. The lever application region 30 for the lever 14 is positioned facing the reduced gap width area, as in FIG. 5.

Figure 7:
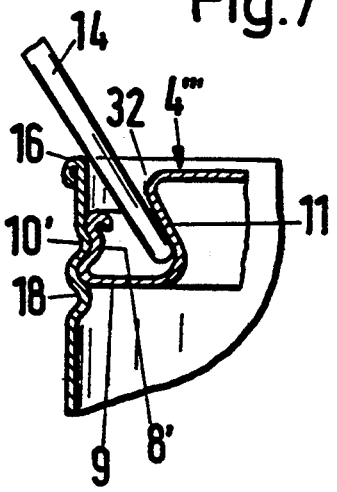
FIG. 7 is a section view of the closure region of a can constructed in accordance with an embodiment of the invention, depicted with a removal lever in position.

FIG. 7 shows another embodiment of the lid closure with a radially inwardly stamped closure corrugation 10'. The lid member 4''' has an engagement lip 8, in which is stamped a radially inwardly directed engagement corrugation 8', which is adapted to the closure corrugation 10' with respect to the cross-sectional shape. As a termination of the engagement lip 8 above the engagement corrugation 8', the rim can be rolled inwards.

In the case of a hermetically sealed closure the engagement corrugation 8' is coated with the sealant 22 and with the latter still in the liquid state is pressed over the closure corrugation 10' until the closure locks.

Figure 8:
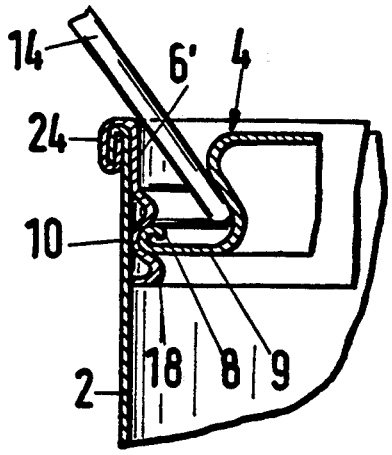
FIG. 8 is a section view of the closure region of a can constructed in accordance with an embodiment of the invention having a double grooved closure and separate body element, depicted with a removal lever in position.

FIG. 8 shows an embodiment, which can mainly be used in the case of pressure lid cans with a one-piece body member 2. A body element 6 is connected as a separate part via a double grooved closure 24 to the body member 2. This body element 6 has an outwardly stamped closure corrugation 10 and a particularly pronounced lower body corrugation 18, which can project further radially inwards than the lower body corrugation 18 stamped in the body member 2 in the other embodiments. Thus, the supporting surface of the lower body corrugation 18 is increased.

The separate body element 6' can also have an upper body corrugation 20 which, following the joining together of the lid member 4 and the body element 6, can be subsequently stamped further radially inwards in another operation.

In the case of a one-piece body member 2, the lid closure can be supplied as a unitary closure element constituted by the lid member 4 and the body element 6' in the assembled state to a filling enterprise, which then connects the lid closure in a conventional manner via the double grooved closure 21 to the one-piece body member 2.

Figure 9:
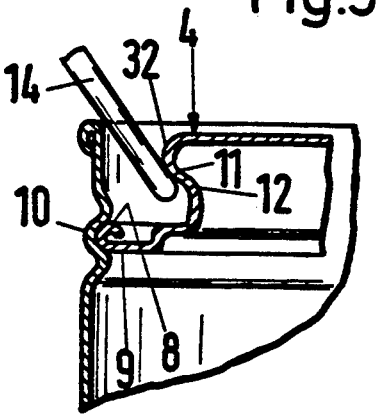
FIG. 9 is a section view through the closure region of a lid constructed in accordance with an embodiment of the invention, depicted with a removal lever in position.

FIG. 9 shows another embodiment of a lid member, in which a particularly pronounced force application corrugation 12 is stamped in the vicinity of the resilient leg 11. This force application corrugation 12 permits a clearly defined force application point for the lever 14 and the lever force does not act directly on the resilient leg 11 and instead only exerts an upwardly directed tension on the lid member 4.

Figure 10:
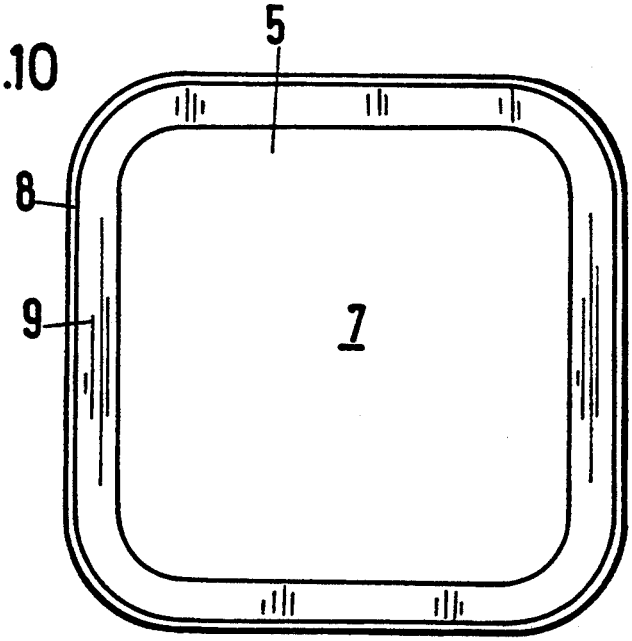
FIG. 10 is a plan view of a rectangular lid constructed in accordance with an embodiment of the invention.

FIG. 10 shows an embodiment of the pressure lid can with a non-rotationally symmetrical cross-sectional shape. In plan view the lid member has a substantially rectangular shape with markedly rounded corners.

Figure 11:
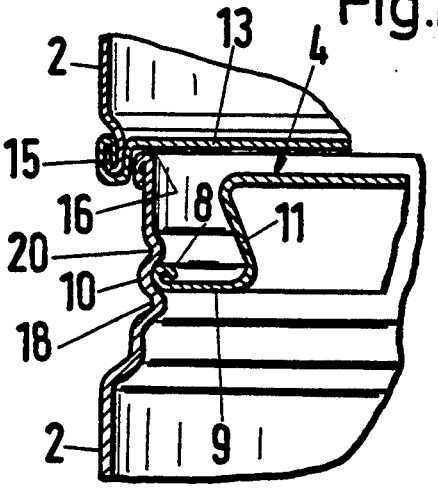
FIG. 11 is a section view of the closure portion of a stackable pressure lid can constructed in accordance with an embodiment of the invention.

FIG. 11 shows a final embodiment similar to FIG. 1, in which the upper body portion 34 is necked inwards to a smaller external diameter. The corrugations necessary for the lid closure are provided in the necked-in body portion 34. As a result of the slightly reduced external diameter of the upper body portion the pressure lid cans are advantageously rendered stackable without the stacked cans being located on the lid member 4, in that the bottom 13 of a stacked can 1 rests on the upper edge 16 of the can 1 below it. Another advantage is that the material consumption for the lid member 4 is reduced due to the smaller diameter.

Instead of being made from thin metal sheeting the lid member 4 can also be made from plastic. The engagement lip 8 can be rolled from solid material and the material thickness can be greater.

The inventive features disclosed in the description, drawings and claims can be essential to the realization of the various embodiments of the invention both individually and in random combination.

We claim:

1. A pressure lid can comprising a body member with a closure-side end having a radially outwardly bowed closure corrugation for interfittingly engaging an engagement lip and a lid member with a lid top and a closure border including an all-round resilient engagement lip, a ring flange and a resilient leg, said resilient leg passing from said lid top into said ring flange, said ring flange projecting substantially horizontally and radially outward from said resilient leg, said engagement lip being connected to said resilient leg via said ring flange and provided on said closure border radially outward of said ring flange and said lid top for interfittingly engaging into said closure corrugation under pretension from inside of said body member to form a tight closure while leaving an exposed lever gap between said body member and said lid member to permit engagement of a lever by means of which the lid member can be levered up, said lever gap being bordered by said resilient leg, said ring flange and at least a part of said closure-side end of said body member.

2. The pressure lid can according to claim 1, wherein said lid member includes an all-round force application corrugation for a lever above a plane through said engagement lip.

3. The pressure lid can according to claim 2, further comprising a radially inwardly stamped, lower body corrugation located immediately below said closure corrugation.

4. The pressure lid can according to claim 3, further comprising a radially inwardly stamped, upper body corrugation positioned immediately above said closure corrugation.

5. The pressure lid can according to claim 4, further comprising a sealant between said closure corrugation and said engagement lip.

6. The pressure lid can according to claim 5, wherein said closure side end is in one piece with said body member.

* * * * *